US006824264B2

(12) United States Patent
Shima et al.

(10) Patent No.: US 6,824,264 B2
(45) Date of Patent: Nov. 30, 2004

(54) IMAGE FORMING APPARATUS

(75) Inventors: Kazunobu Shima, Wakayama (JP); Hidetoshi Nishikawa, Wakayama (JP); Masazumi Ishikawa, Wakayama (JP); Kazuo Nagaosa, Wakayama (JP); Masaki Nakamoto, Wakayama (JP); Masanori Inoshita, Wakayama (JP); Masasuke Funase, Wakayama (JP)

(73) Assignee: Noritsu Koki Co., Ltd., Wakayama-Ken (JP)

( * ) Notice: Subject to any disclaimer, the term of this patent is extended or adjusted under 35 U.S.C. 154(b) by 0 days.

(21) Appl. No.: 10/365,221

(22) Filed: Feb. 12, 2003

(65) Prior Publication Data

US 2003/0169322 A1 Sep. 11, 2003

(30) Foreign Application Priority Data

| | | |
|---|---|---|
| Feb. 14, 2002 | (JP) | 2002-036980 |
| May 14, 2002 | (JP) | 2002-138749 |
| Dec. 4, 2002 | (JP) | 2002-352597 |

(51) Int. Cl.[7] ..... B41J 2/01
(52) U.S. Cl. ..... 347/102; 347/101
(58) Field of Search ..... 347/102, 101; 34/275, 308, 420, 245; 399/69, 328

(56) References Cited

U.S. PATENT DOCUMENTS

| | | | | |
|---|---|---|---|---|
| 5,771,054 A | | 6/1998 | Dudek et al. | |
| 6,120,199 A | * | 9/2000 | Takekoshi | 347/102 |

FOREIGN PATENT DOCUMENTS

| | | | | |
|---|---|---|---|---|
| DE | 42 35 668 A | | 4/1994 | |
| DE | 4235668 A1 | * | 4/1994 | G03G/15/20 |
| EP | 0 925 945 A | | 6/1999 | |
| JP | 08-311782 | | 11/1996 | |
| JP | 10-016188 | | 1/1998 | |
| JP | 10-230589 | | 9/1998 | |
| JP | 10-297197 | | 11/1998 | |
| JP | 2001-105638 | | 4/2001 | |

* cited by examiner

*Primary Examiner*—Manish Shah
(74) *Attorney, Agent, or Firm*—Fulbright & Jaworski L.L.P.

(57) ABSTRACT

An image forming apparatus fixes, by heating, an image formed on a sheet-like recording medium thereto with sublimating ink. The apparatus includes a heating fixing unit for receiving and heating the recording medium and then discharging the heat-fixed recording medium, the heating fixing unit including a heating space for heating the recording medium and a transporting mechanism for transporting the medium in the heating space. The apparatus further includes a smoothing-out mechanism for discharging the recording medium from the heating space while smoothing out or flattening the recording medium.

7 Claims, 11 Drawing Sheets

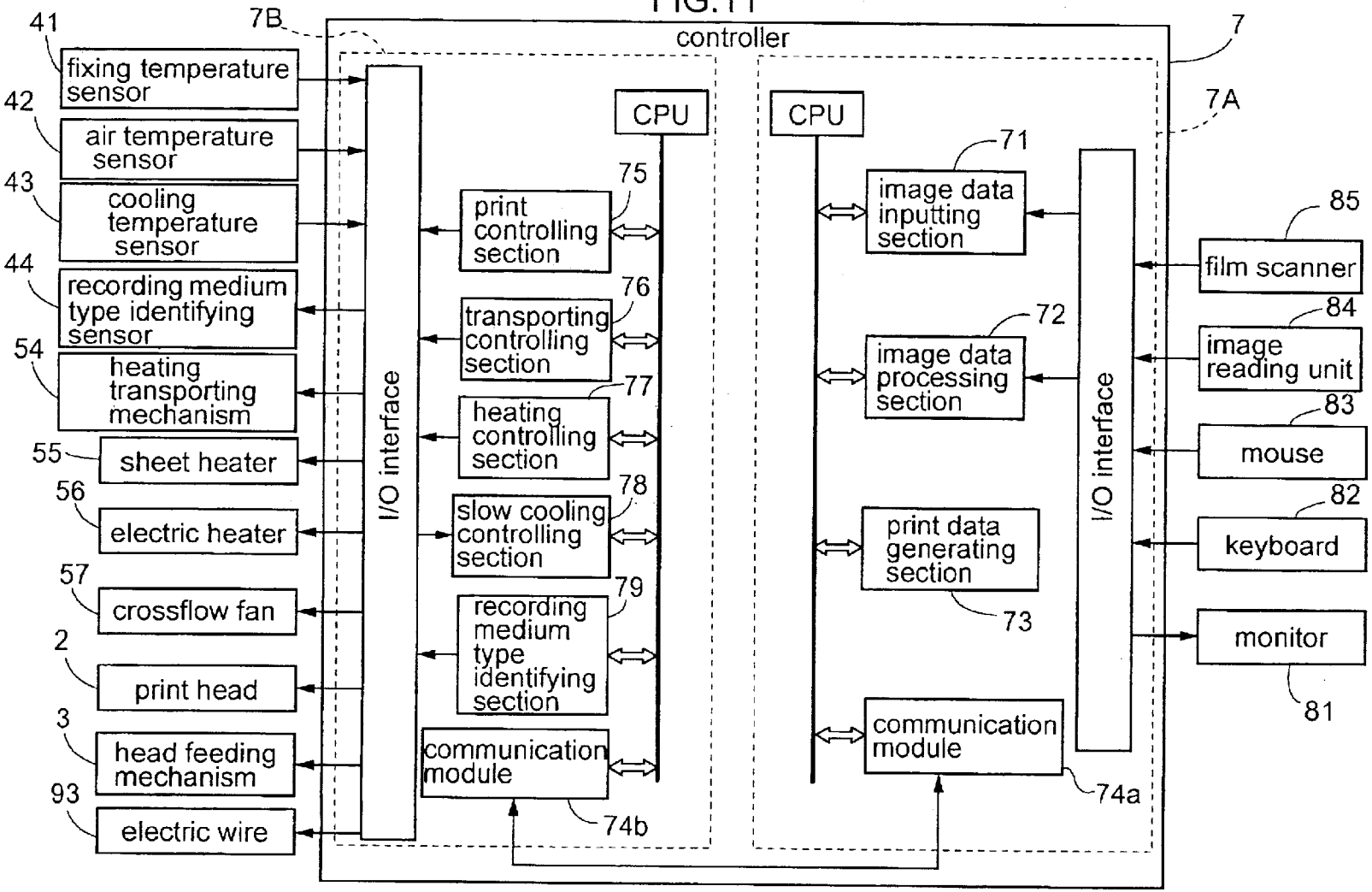
FIG.11
controller
7
7A
7B
film scanner
image reading unit
mouse
keyboard
monitor
85
84
83
82
81
I/O interface
CPU
image data inputting section
image data processing section
print data generating section
communication module
71
72
73
74a
CPU
print controlling section
transporting controlling section
heating controlling section
slow cooling controlling section
recording medium type identifying section
communication module
75
76
77
78
79
74b
I/O interface
fixing temperature sensor
air temperature sensor
cooling temperature sensor
recording medium type identifying sensor
heating transporting mechanism
sheet heater
electric heater
crossflow fan
print head
head feeding mechanism
electric wire
41
42
43
44
54
55
56
57
2
3
93

IMAGE FORMING APPARATUS

BACKGROUND OF THE INVENTION

1. Field of the Invention

The present invention relates to an image forming apparatus for fixing, by heating, an image formed on a sheet-like recording medium thereto with sublimating ink.

2. Description of the Related Art

An exemplary conventional technique relating to the above field of art is disclosed in Japanese patent application "Kokai" No: Hei. 10-297197. According to this, a metal substrate includes a coloring ground layer acting also as a rust-preventive layer, a transparent resin layer as an optical transparent resin layer formed over the coloring ground layer, the resin layer (made of e.g. porous alumina) being made of acrylic resin, polyester resin, urethane resin etc., and an inkjet receiving layer formed over the resin layer and made of e.g. porous alumina. After application of a sublimating ink or pigment on the inkjet receiving layer by an inkjet printing, the sublimating pigment is heated in a heating furnace or by a hot press, whereby the sublimating pigment in the inkjet receiving layer is sublimed into the transparent resin layer. Then, the inkjet receiving layer is removed to obtain an ornamental metal body having a colored pattern fixedly formed within the transparent resin layer (see, for example, paragraphs Nos. 0010–0013 and FIG. 4). This image forming art can be applied to a recording medium using, as a substrate thereof, metal material which is hardly deformed by heat. However, if this art is applied to a recording medium using, as a substrate thereof, e.g. resin material which is deformed significantly by heat, occurrence of thermal deformation in the substrate during the heating process, especially, "wrinkles" cannot be avoided.

Further, Japanese patent application "Kokai" No: Hei. 10-16188 discloses an image forming apparatus. According to this, first, a primary image is formed on a thermal transfer sheet by e.g. an inkjet printer. Then, this thermal transfer sheet having the image formed thereon is laid over a recording sheet and these sheets are pressed and heated together by means of heat press rollers whose temperature is controlled, whereby the image (ink) formed on the thermal transfer sheet will be sublimed by the heat and transferred onto an ink fixing layer of the recording sheet (see, for example, paragraphs Nos. 0008–0012 and FIG. 1). In the case of this image forming technique, the surface temperature control of the heat fixing roller is strictly effected. However, since the contact between the heat press rollers and the recording sheet is substantially line contact, the surface of the recording sheet at the normal temperature (room temperature) is heated and pressed momentarily and then left to cool at the normal temperature again. Therefore, if material such as resin sensitive to heat is employed as the substrate of the recording sheet, wrinkles developed during the heating process will remain after the cooling.

According to further art disclosed by Japanese patent application "Kokai" No: 2001-105638, sublimating ink is transferred from an ink ribbon onto a surface of a recording sheet. In order to heat and fix the ink on the sheet, the sheet is charged into a heater box, in which the sheet is advanced and heated between a press roller and a heat roller opposed to each other with a small gap therebetween or between a heat roll and a conveyer belt disposed along a portion of the peripheral face of the heat roll, and then the sheet is discharged by a transport roller from the heater box immediately (see, for example, paragraph Nos. 0039–0058 and FIG. 1). With this image forming technique, the recording sheet heated by the heating roller is immediately discharged from the heater box into the normal temperature. Therefore, if material such as resin sensitive to heat is employed as the substrate of the recording sheet, wrinkles developed during the heating process will remain after the cooling.

Further, though differing in the properties in the recording medium from the present invention, in the field of textile printing, according to an exemplary technique disclosed by Japanese patent application "Kokai" No: Hei. 08-311782, in order to obtain a print of a graphic image of as clear definition as possible, printing is effected by means of the inkjet printing method on a textile whose wrinkles were smoothed out by smoothing out rolls. After printing, in order to reinforce the fixing of the dye and also to improve its color development, the textile is charged into a heater device to be heated therein. Then, the textile is discharged from the device immediately to be cooled at the normal temperature (see paragraphs Nos. 0041–0043, 0061–0070 and FIG. 2). This art, however, does not provide any means for removing "wrinkles" after completion of the heating process. Therefore, if this art is employed for a recording material of not textile but some heat-sensitive material such as resin, the wrinkles developed during the heating process will remain.

SUMMARY OF THE INVENTION

In view of the above, a primary object of the present invention is to provide an image forming apparatus usable for a recording material using a heat-sensitive material such as resin as the substrate thereof as the apparatus has a function for eliminating deformation developed in a recording medium during heating thereof by a heating fixing unit before cooling of the medium.

For accomplishing the above-noted object, according to the present invention, an image forming apparatus for fixing, by heating, an image formed on a sheet-like recording medium thereto with sublimating ink, the apparatus comprising:

a heating fixing unit for receiving and heating the recording medium and then discharging the heat-fixed recording medium, the heating fixing unit including a heating space for heating the recording medium and a transporting mechanism for transporting the medium in the heating space; and a smoothing-out mechanism for discharging the recording medium from the heating space while smoothing out or flattening the recording medium.

With the above construction, according to the image forming apparatus of the invention, the recording medium printed with image with the sublimating ink is introduced into the heating space by the transporting mechanism, where the medium is exposed to a required heating process for stably fixing the image thereon. And, the resultant recording medium is automatically discharged from the heating space. In the course of this, when the recording medium is being discharged from the heating space, this medium retaining the heat received in the heating space, thus having sufficient plasticity is subjected to the function of the smoothing-out mechanism. Therefore, even if deformation has occurred during the heating for ink fixation or due to application of an external force during its transport, this deformed recording medium may be effectively smoothed out into the appropriate flat shape.

Preferably, the smoothing-out mechanism includes a curved transporting section for forcibly bending the recording medium discharged or being discharged from the heating space into a direction for bending the medium as viewed from its lateral side.

Namely, in this type of recording medium, there tend to develop wrinkles in the form of wave-like undulations in the cross section of the medium. Therefore, with the above-proposed construction, the recording medium is forcibly bent in the direction traversing such wave-like undulations, such that such type of wrinkles may be effectively eliminated or occurrence of such type of wrinkles may be avoided in advance.

Preferably, the curved transporting section is arranged in such a manner as to orient the image-formed face of the recording medium to the outer side. With this, when the recording medium is caused to pass the curved transporting section, a tension will occur on the outer face of the recording medium on which the image is formed and this tension serves to smooth out fine wrinkles on the surface of the medium.

Still preferably, the curved transporting section includes an angular member extending straight along the width direction of the recording medium, a guide mechanism for forcibly bending the recording medium by pressing the recording medium against the angular member, and a heating mechanism for heating the angular member.

With this construction, the width-wise entire area of the recording medium will be pressed at one time against a projecting portion of the angular member extending straight, so that the medium may be subjected to a uniform smoothing-out effect particularly in the width direction thereof. Further, this angular member is heated to a high temperature by the heating mechanism, the recording medium discharged from the heating space and having a gradually reducing temperature can be heated again for recover its thermal plasticity and processed under this condition. Consequently, the recording medium may be bent smoothly, thus realizing very effective smoothing out of the medium.

The angular member can be considered as a group of infinitely small and an infinite number of smoothing-out elements arranged straight along the main scanning direction. And, the recording medium being moved in the sub scanning direction by the transporting mechanism can be considered as being discharged while being uniformly smoothed out in the width direction thereof along and on these smoothing-out elements.

Preferably, the angular member is disposed downwardly of the recording medium to be discharged and the guide mechanism includes a guide face which is inclined downward relative to a posture of the leading end of the discharged recording medium.

With this construction, the leading end of the recording medium discharged from the heating space of the heating fixing unit will be pressed against the inclined guide face to be oriented downward. Thus, the bending of the recording medium in the side view thereof may take place smoothly. Further, this bending will occur such that the transportation-wise downstream portion of the medium is bent downward, which bending direction agrees with the bending direction under the gravity, i.e. under the effect of the dead weight of the recording medium per se. Therefore, the recording medium bent by the curved transporting section can be effectively pressed against the corner of the angular portion with the help of the dead weight of the recording medium i.e. the gravity.

Preferably, downwardly of the guide face, there is provided a partitioning wall for forming an open space around the recording medium. With this, by maintaining the air temperature of this pace at a relatively high value, discharge of heat from the angular member or the exit of the heating space may be effectively restricted. At the same time, this can restrict rapid discharge of heat from the recording medium discharged from the heating space. Consequently, as the recording medium is guided with an appropriate posture thereof while the angular member of the inside of the heating space is maintained at the relatively high temperature, the smoothing-out operation on the recording medium can proceed effectively and appropriately.

Still preferably, the apparatus further comprises a stocker for receiving the recording medium discharged from the smoothing-out mechanism with a posture in which the leading end of the medium is inclined downward.

With this construction, even when the recording medium past the smoothing-out section is discharged in the form of being dropped or when an elongated medium is discharged continuously, the recording medium may be received by the stocker with the lower end of the medium being caused to slide on the inclined face of the stocker disposed below. Therefore, by guiding the recording medium along the inclination direction of the stocker, the medium can be collected compactly and smoothly.

Alternatively, the smoothing-out mechanism includes a press roller mechanism for pressing the recording medium discharged or being discharged from the heating space against a flat face.

With this, it become possible to apply the pressing force to the recording medium in a reliable manner, regardless of difference in the thickness of the recording medium. Adjustment of the pressing force is possible by e.g. attaching a weight to the roller. Needless to say, it will be also possible to apply a predetermined urging force to the roller by means of e.g. a spring. However, the construction utilizing a dead weight alone will be simpler and less costly. With this construction, any deformation such as wrinkles developed in the surface of the recording medium during the heating process by the heating fixing unit may be "ironed out" by the effect of the press roller on the medium still having high temperature and associated plasticity at the last stage of the heating process. Hence, the deformation such as wrinkles may be eliminated before the medium is cooled. Therefore, such wrinkles will not remain in the final printed product after the cooling process.

Preferably, the press roller mechanism includes a stationary roller supported to be rotatable about a fixed horizontal shaft and a movable roller supported to be movable closer to and away from the peripheral face of the stationary roller, the movable roller being urged in the direction closer to the peripheral face.

With this construction, as the movable roller is movable closer to and away from the peripheral face of the stationary roller, the press roller mechanism can receive recording media of various thicknesses. Further, the press roller mechanism can receive also a recording medium having very large wrinkles in the thickness direction thereof. Further, as the movable roller is urged in the approaching direction, this roller can positively contribute to the smoothing of the deformation such as wrinkles.

Incidentally, the deformation such as wrinkles developed in the surface of the recording medium during the heating process at the heating fixing unit may be dissolved by e.g. the ironing effect of the press roller mechanism. However, if the recording medium is suddenly discharged from the heating fixing unit to the outside, resultant rapid cooling experienced by the recording medium from the temperature inside the heating space to the room temperature can lead to new occurrence of deformation such as wrinkles in the medium.

Then, the apparatus may further comprise a slow cooling mechanism disposed downstream of the smoothing-out mechanism in the transporting direction of the recording medium and adapted for slowly cooling the discharged recording medium to the normal temperature, and the slow cooling mechanism includes a guide member having a slide guiding face along which the recording medium is slid and a heater for controlling the temperature of the slide guide face to have a temperature gradient that the temperature of the slide guide face is lowered gradually along the transporting direction of the recording medium.

With the above construction, the recording medium which was heated at the heating fixing unit for heat fixation of the printed image is slowly returned from the ink fixing temperature (generally, 150° C. or more) to the normal temperature (room temperature) by the slow cooling mechanism. As a result, occurrence of deformation such as wrinkles due to rapid cooling from the temperature inside the heating fixing unit (ink fixing temperature) to the normal temperature (room temperature) may be effectively restricted. Accordingly, there has been realized an image forming apparatus which can not only eliminate the wrinkles developed in the heating process, but also avoid further wrinkles which could occur during the cooling process.

Further and other features and advantages of the invention will become apparent upon reading the following detailed description of preferred embodiments thereof with reference to the accompanying drawings.

BRIEF DESCRIPTION OF THE DRAWINGS

FIG. 11 is a functional block diagram illustrating various functions of a controller.

DESCRIPTION OF THE PREFERRED EMBODIMENT

A preferred embodiment of an image forming apparatus relating to the present invention will be described with reference to the accompanying drawings.

(Recording Medium)

Figure 1:
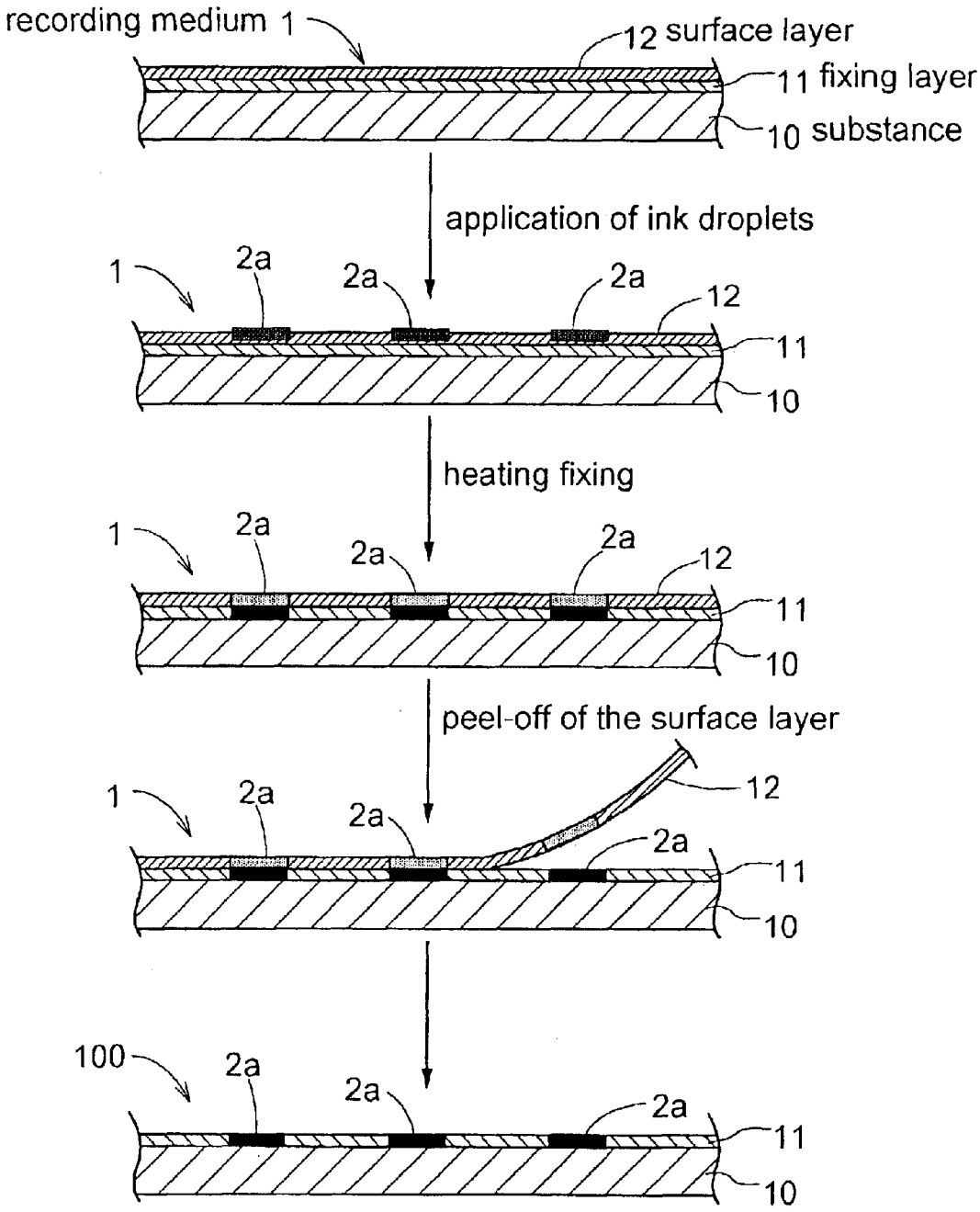
FIG. 1 is a section view showing an example of recording medium to be processed by the present invention.

First, an example of a recording medium 1 to be processed by the invention will be described with reference to FIG. 1. This recording medium 1 includes a substrate 10 made of a film sheet of e.g. PET (polyethylene terephthalate), a fixing layer 11 formed of e.g. urethane resin and placed over the surface of the substrate 10 for fixing therein ink, that is, ink pigment, and a surface layer 12 placed on the surface of the layer 11 and acting as a receiving layer for receiving the ink. In case the surface of the substrate 10 has a property allowing direct fixation of the ink pigment thereon, the fixing layer 11 may be omitted. In use, ink droplets are applied by e.g. an inkjet printer to the surface layer 12 of this recording medium 1 to form thereon a printed image constituted, after which, when heated to an appropriate temperature, the ink droplets (un-sublimated print dots) applied on the surface layer 12 begin to sublime and permeate the surface layer 12 to reach the underlying fixing layer 11, so that the ink pigment, now as sublimated print dots, is fixed within the fixing layer 11. Accordingly, by removing or "peeling off" the surface layer 12, there will be obtained, as a final printed product 100, an image recorded sheet having high gloss and high image definition bearing the printed image formed of the sublimated print dots in its fixing layer 11. Incidentally, as this recording medium requires, at the last stage, removal of the surface layer 12 from the fixing layer 11 or the substrate 10, it will be advantageous to provide a releasing agent therebetween.

(Image Forming System)

Next, an exemplary image forming system for producing the final printed product 100 with using the above-described recording medium 1 will be described with reference to FIG. 2 and FIG. 3. As shown, this image forming system consists mainly of a printing station PS and an operator's station OS.

(Printing Station PS)

The printing station PS includes an inkjet type printing unit PU, a loop-forming unit RU for temporarily holding the recording medium 1 bearing a printed image formed of un-sublimated print dots by the printing unit PU, and a heating fixing unit HU for applying thermal energy to the recording medium 1 sent from the loop-forming unit RU to produce a printed image formed of sublimated print dots, and a slow cooling unit CU for slowing cooling the recording medium 1 discharged from the heating fixing unit HU to a normal temperature (room temperature). Adjacent the exit of the heating fixing unit HU, there is provided a smoothing-out mechanism D for discharging the recording medium 1 from the heating space of the heating fixing unit while smoothing out or flattening this medium 1. This smoothing-out mechanism D includes a press roller mechanism 58 and a curved transporting section 59.

Incidentally, the loop-forming unit RU provided between the printing unit PU and the heating fixing unit HU serves to absorb a speed difference existing between a relatively low transport speed of the recording medium 1 provided by the heating fixing unit HU and a relatively high average transport speed of the medium 1 provided by the printing unit PU. The printing unit PU, loop-forming unit RU and the heating fixing unit HU are provided as separate units detachably connectable to each other. The slow cooling subunit CU is attached to the heating fixing unit HU.

(Printing Unit PU)

Figure 4:
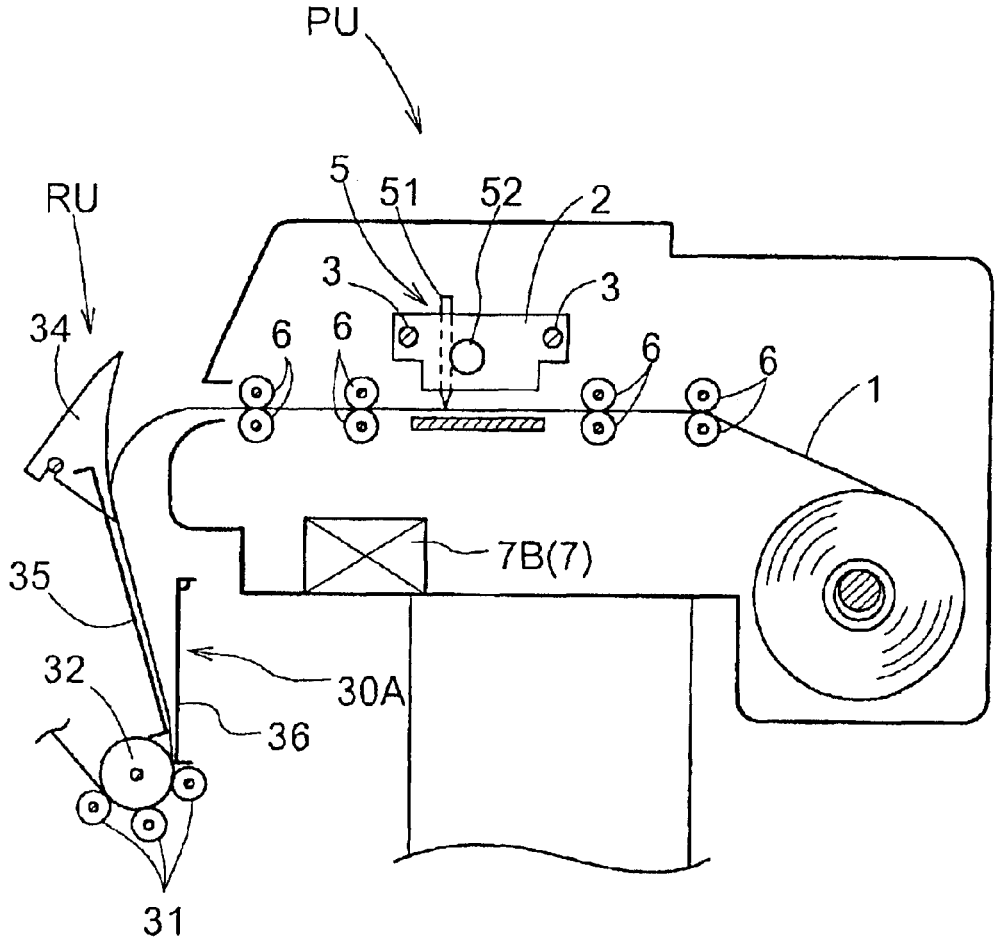
FIG. 4 is a schematic section showing a construction of a printing unit included in the printing station.

As can be seen from FIG. 4, within the printing unit PU, a sheet transport mechanism 6 transports the recording medium 1 while unwinding this recording medium 1 from an unillustrated roll-sheet cartridge in which the medium 1 is stored in the form of a roll, in such a manner that the surface layer 12, the printing surface, of the medium may be brought adjacent an ink discharging outlet of an inkjet type print head 2. The print head 2 is mounted to be movable back and forth by a head feeding mechanism 3 along a direction traversing the transporting direction of the recording medium 1 (that is, along a main scanning direction). As the recording medium 1 is transported along a sub-scanning direction with each stroke of movement of the print head 2 in the main scanning direction with discharging ink through its ink discharging outlet against the surface layer 12 of the recording medium 1, printed images will be formed in succession.

The print head 2 includes a plurality of discharging outlet modules capable of respectively discharging inks of different principal colors depending on the characteristics of the color printed image to be formed. For instance, if a color printed image of photographic quality is needed, in addition to inks of primary colors of cyan, magenta, yellow, black etc, further inks of tint colors of same kind will be generally used. The print head 2 may be a standard print head used in a conventional inkjet printer. After a printed image is formed on its surface layer 12 with the ink droplets 2*a* discharged from the print head 2, the recording medium 1 exits the printing unit PU to enter the loop-forming unit RU.

The recording medium 1 is provided in the form of an elongate sheet from its manufacturer. Hence, it is necessary to cut it to a size of a printed image formed thereof. To this end, a sheet cutter means 5 is provided. In this embodiment, the sheet cutter means 5 includes a cutter blade body 51 switchable between a position where the body projects toward the recording medium 1 relative to the print head 2 and a further position where the body is retracted away from the recording medium 1, and a switchover motor 52 for switching over the cutter blade body 51 between the two positions through e.g. a cam-feed or screw-feed mechanism (not shown).

(Loop-forming Unit RU)

Figure 3:
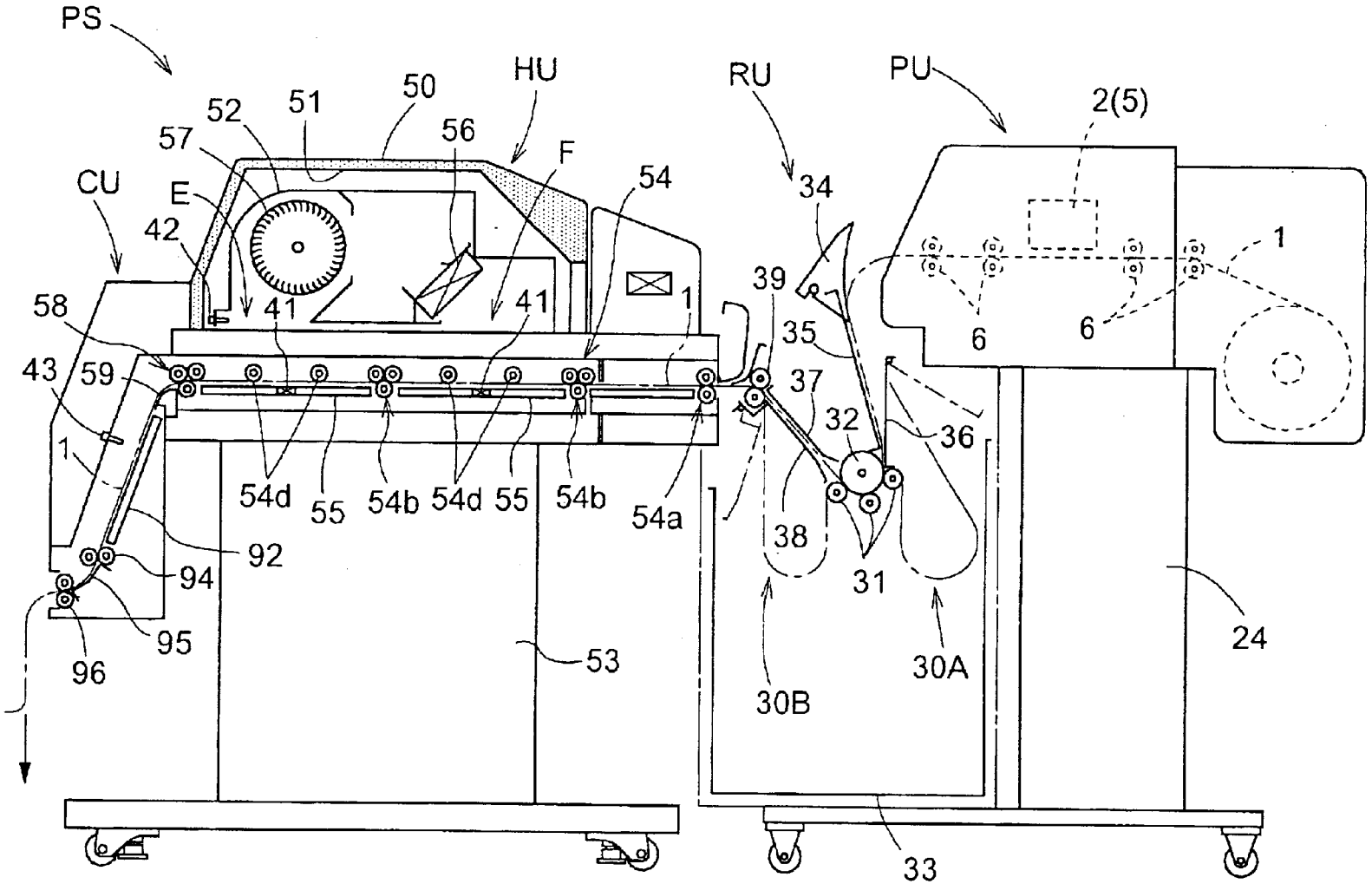
FIG. 3 is a schematic section showing a construction of a printing station of the image forming apparatus.

Though shown only schematically in FIG. 3 the loop-forming unit RU includes a turn roller 32 having three driven rollers 31 at the center thereof, a first loop-forming mechanism 30A disposed transportation-wise upstream of the turn roller 32, a second loop-forming mechanism 30B disposed transportation-wise downstream of the turn roller 32, and a case 33 for receiving the recording medium 1 at a position downwardly of these components.

The turn roller 32 is driven by an unillustrated motor; and as its three driven rollers 31 are pressed against the outer periphery of this turn roller 32, the turn roller 32 winds the recoding medium 1 about it, so that this roller 32 provides a function for eliminating or adjusting any curling tendency present in the recording medium 1 as furnished from its manufacturer. The first loop-forming mechanism 30A includes an introduction guide 34 for downwardly guiding the recording medium 1 discharged from an exit of the printing unit PU, a first stationary guide 35 for further downwardly guiding the recording medium 1 which has been guided downwardly by the introduction guide 34 and a first movable guide 36 disposed in opposition to the first stationary guide 35. The first movable guide 36 is pivotable by means of an unillustrated motor about a pivot axis disposed at the top end of the guide, so that the guide 36 can selectively assume a closed posture denoted with a solid line or a opened posture denoted with a virtual line.

The second loop-forming mechanism 30B includes a second stationary guide 37 for guiding the recording medium 1, which has been transported from the first loop-forming mechanism 30A via the turn roller 32, to the heating fixing unit HU, a second movable guide 38 disposed in opposition to the second stationary guide 37, and a clamping type feed roller 39 for feeding the recording medium 1 to the heating fixing unit HU. The second movable guide 38 is pivotable by means of an unillustrated motor about a pivot axis disposed at the top end of the guide, so that the guide 38 can selectively assume a closed posture denoted with a solid line or a opened posture denoted with a virtual line.

In this loop-forming unit RU, at respective positions along the transport passage of the recording medium 1, sensors (not shown) are provided for detecting presence/absence of the recording medium 1 and a control operation described below is effected based on detection signals from these sensors. Namely, when the recording medium 1 is discharged from the printing unit PU, the first movable guide 36 is set to its closed posture and also the turn roller 32 is rotated at a low speed, thereby to guide the leading end of this recording medium 1 from the introduction guide 34 to the turn roller 32. Upon confirmation of clamped retention of the leading end of the recording medium 1 between the turn roller 32 and the driven rollers 32, the first movable guide 36 is switched over to its opened posture, whereby the recording medium 1 is stored under a suspended condition within the first loop-forming mechanism 30A.

Next, upon detection of the tailing end of the recording medium 1 transported from the printing unit PU, the second movable guide 38 is set at its closed posture and under this condition, the control initiates driving of the turn roller 32 and the feed roller 39, thereby to transport the leading end of the recording medium 1 to the feed roller 39 of the second loop-forming mechanism 30B, so that the feed roller 39 clamps the leading end of the recording medium 1 and proceeds to send the medium into the heating fixing unit HU at a speed substantially equal to the transport speed of the recording medium 1 by the heating fixing unit HU and at the same time, after switching over the second movable guide 38 to its opened posture, the turn roller 32 is driven to rotate at a high speed, whereby the recording medium 1 retained within the first loop-forming mechanism 30A is stored under a suspended condition within the second loop-forming mechanism 30B. In this way, upon sending of the recording medium 1 from the first loop-forming mechanism 30A into the second loop-forming mechanism 30B, the control operation is resumed for introducing the recording medium 1 from the printing unit PU into the first loop-forming mechanism 30A in the manner described above.

(Heating Fixing Unit HU)

Figure 5:
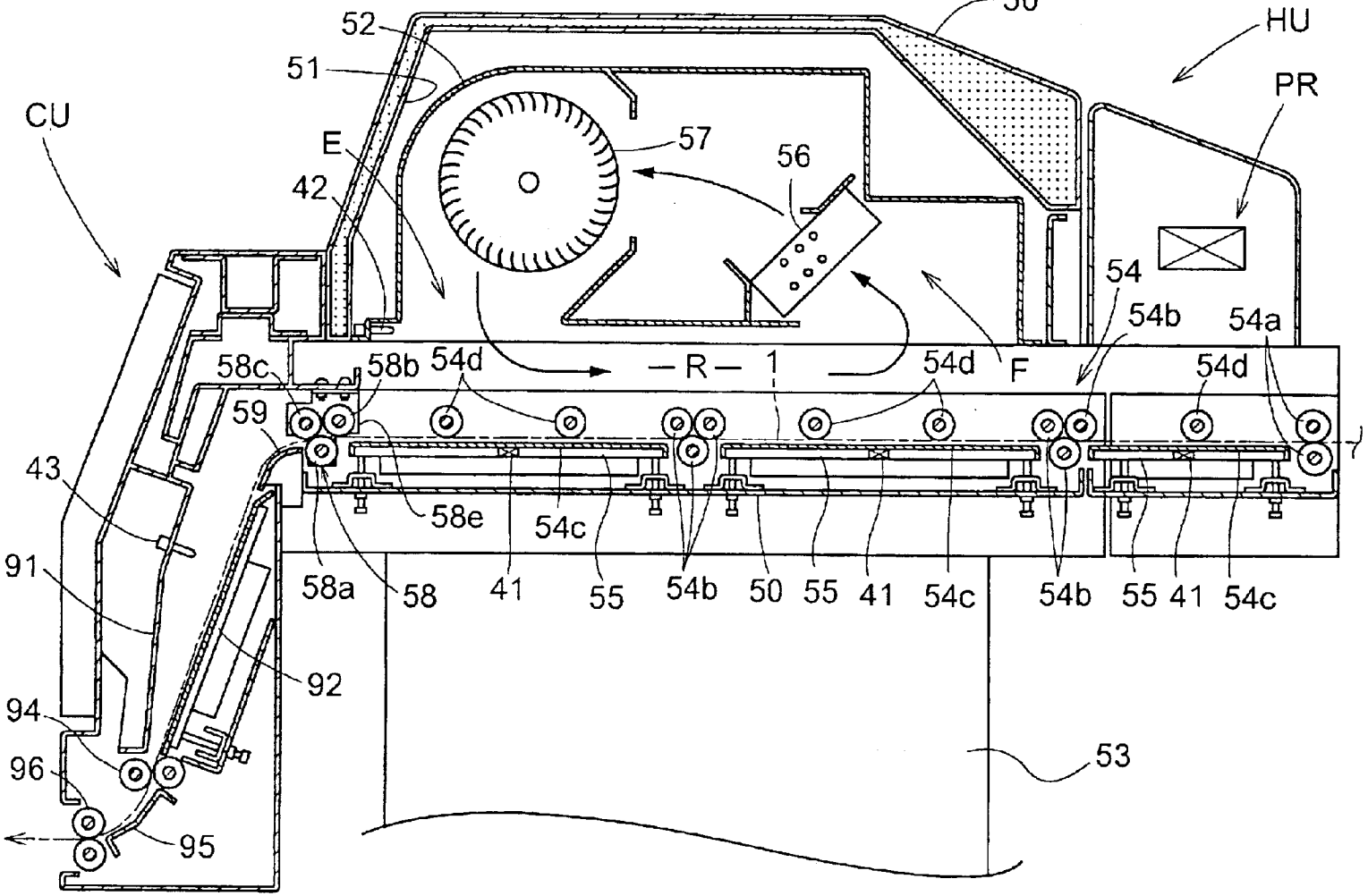
FIG. 5 is a schematic section showing constructions of a heating fixing unit and a slow cooling subunit.

As shown in FIG. 3 and FIG. 5, the heating fixing unit HU includes, within a main casing 50 thereof supported by a support leg 53, a heating case 51 made of insulating material for heating the recording medium 1, and a blower case 52 also made of insulating material and disposed above the heating case 51 for supplying hot air to this heating case 51. Inside the heating case 51, adjacent an entrance thereof, there is formed a preliminary heating space PR and in succession to this preliminary heating space PR, a heating space R is formed. In the preliminary heating space PR and the heating space R, there is disposed a heating transport mechanism 54 for transporting the recording medium 1, the heating transport mechanism 54 constituting a part of the sheet transport mechanism 6.

This heating transport mechanism 54 includes guide members 54*c* provided in the preliminary heating space PR (one) and in the heating space R (two) for coming into contact with the lower face of the recording medium 1 for transmitting heat to the medium 1, a pair of clamping type introducing rollers 54*a* disposed adjacent the entrance of the heating fixing unit HU for introducing the recording medium 1 (inside the preliminary heating space PR), a pair of transport roller mechanism 54*b* disposed between the respective guide members 54*c* for transferring the recording medium 1 to the next adjacent guide member 54*c*, and a press roller mechanism 58 disposed adjacent the exit of the heating fixing unit HU for discharging the recording medium 1 past the last guide member 54*c* from the heating fixing unit HU.

The transport roller mechanism 54*b* includes one lower roller for supporting the back face of the recording medium 1 and two upper rollers disposed parallel with each other for pressing the recording medium 1 against the lower roller, with these three rollers being rotatable about stationary horizontal shafts. Only the lower roller is driven while the upper rollers are free rollers. In order not to give a curling tendency to the recording medium 1, the two upper rollers are arranged at such positions as to form a gap exceeding the thickness of the recording medium 1 between the upper rollers and the lower roller and also to allow the recording medium 1 to be pressed lightly, by its own rigidity, against both the upper rollers and the lower roller. Incidentally, upwardly of the respective guide members 54*c* too, there are provided a plurality of upper face contact rollers 54*d* as drive rollers for coming into light contact with the upper face of the recording medium 1 for applying a transporting force thereto.

The press roller mechanism 58 constitutes a portion of a smoothing-out mechanism D for discharging the recording medium 1 from the heating space of the heating, fixing unit HU while smoothing out, i.e. shaping the medium 1 flat. Further, immediately transportation-wise downstream of this press roller mechanism 58, there is provided a curved transporting section 59, which also constitutes a portion of the smoothing-out mechanism D for flattening the recording medium 1 while it is being discharged from the heating space of the heating fixing unit HU.

On the lower face of the guide member 54*c* disposed downwardly of the upper face contact rollers 54*d*, there are provided a sheet heater 55 for heating this guide member 54*c* and a fixing temperature sensor 41 disposed at the center of this sheet heater 55 for measuring the temperature of the guide member 54*c*.

Inside the blower case 52, there are provided an electric heater 56 in the form of a plurality of rods and a crossflow fan 57 for driving fan blades about an axis extending parallel with the width of the recording medium 1 for feeding hot air. This blower case 52 defines, in its bottom face, an outlet E located immediately below the crossflow fan 57 for discharging hot air and an inlet F located upstream on the transporting passage for the recording medium 1 by the heating transporting mechanism 54. Adjacent the aperture of the outlet E, there is provided an air sensor 42 in correspondence with the crossflow fan 57.

When the recording medium 1 is heated, the electric heater 56 and the crossflow fan 57 are driven, thereby to feed the air heated within the blower case 52 through the outlet E to a position transportation-wise downstream of the recording medium 1 inside the heating case 51 for a feeding width greater than the entire width of the recording medium 1, so that this hot air is caused to flow toward the transportation-wise upstream side along the transporting passage of the recording medium 1. Then, the air is drawn into the blower case 52 through the inlet F at a position transportation-wise upstream of the recording medium 1 to be heated by the electric heater 56. After this, the heated air is supplied to the crossflow fan 57. In this way, the heated air is circulated.

In controlling the heating fixing process, power is supplied to the respective electric heaters 56 so that the air temperature sensor 42 may sense temperature of about 180° C., and to the respective sheet heaters 55 so that the fixing temperature sensor 41 inside the preliminary heating space PR may sense temperature of about 100° C., the transportation-wise upstream fixing temperature sensor 41 inside the heating space R may sense temperature of about 130° C., and the transportation-wise downstream fixing temperature sensor 41 may sense temperature of 180° C., respectively. These target temperatures will be varied in accordance with the properties of the recording medium 1 (including its thickness), the properties of the ink, etc.

(Press Roller Mechanism 58)

Figure 6:
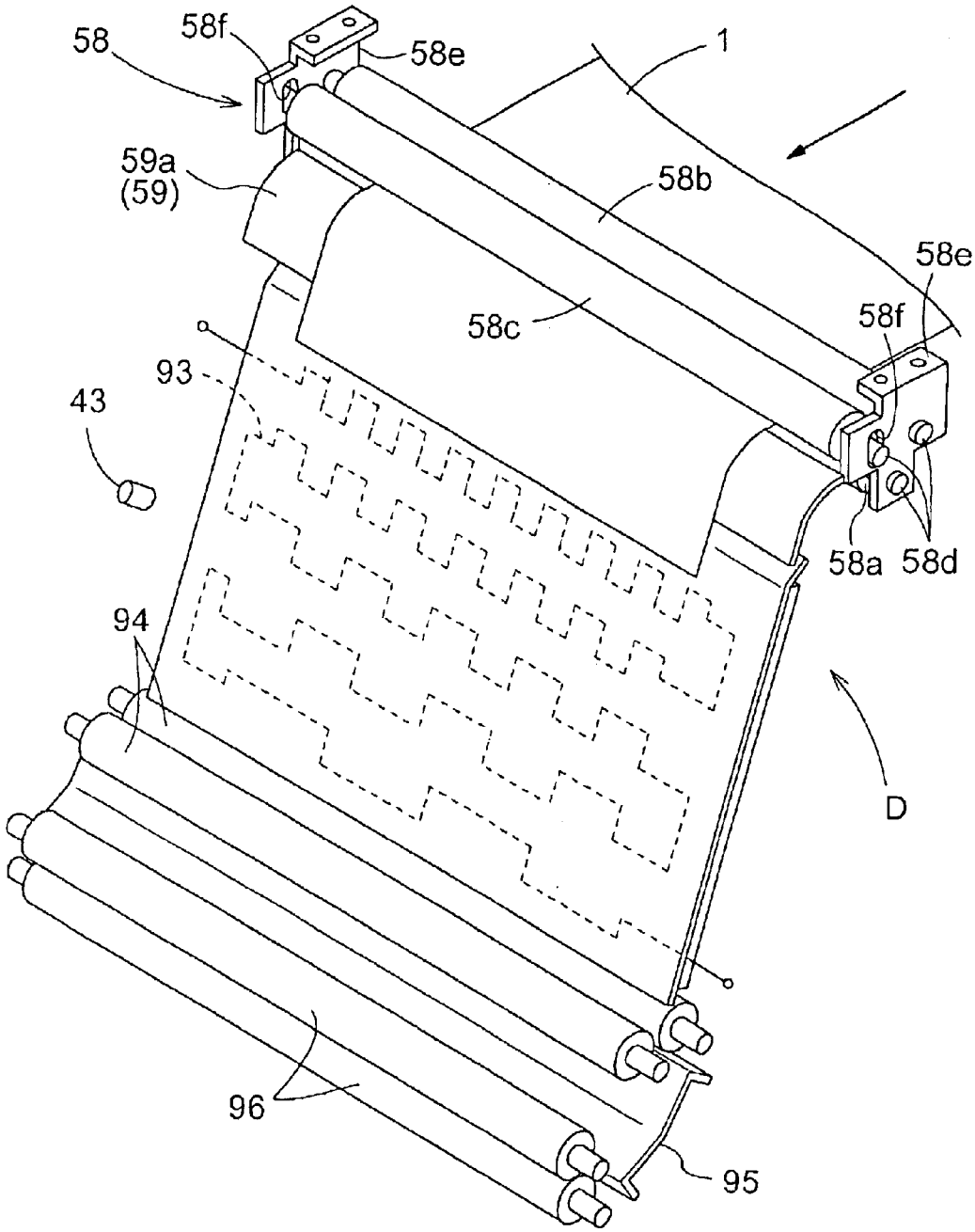
FIG. 6 is a perspective view showing constructions of a press roller mechanism and the slow cooling unit.
Figure 7:
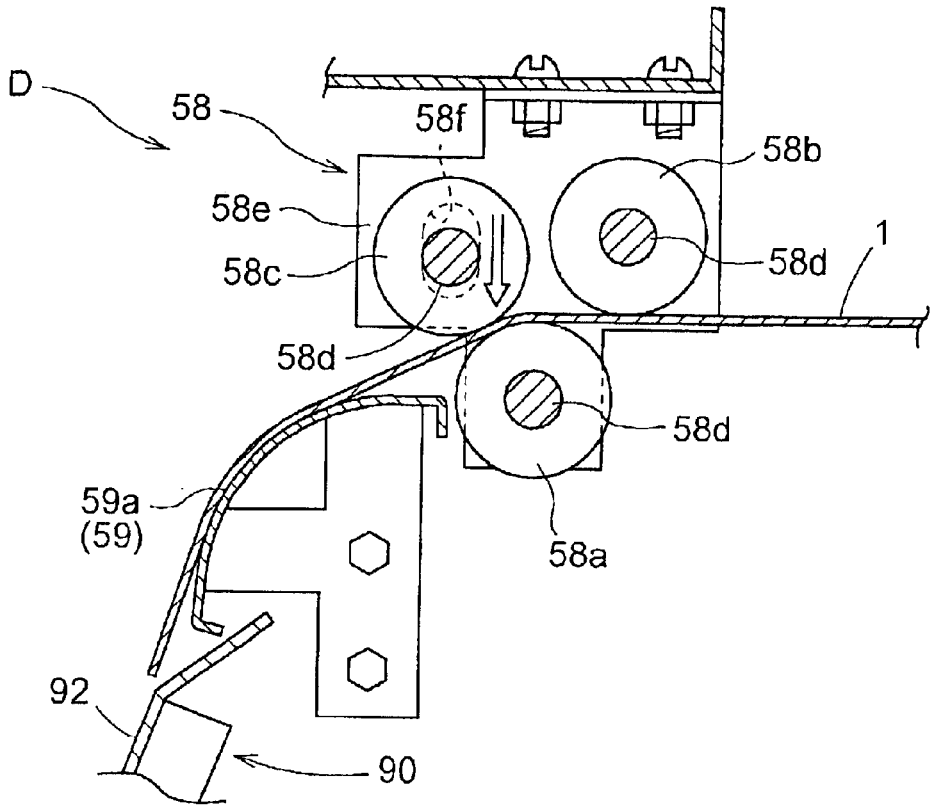
FIG. 7 is an enlarged schematic section showing a construction of a smoothing-out mechanism.

The press roller mechanism 58 is disposed adjacent the exit of the heating fixing unit HU and, as shown in FIG. 6 and FIG. 7, the mechanism includes a first roller 58*a* for coming into contact with the back surface of the recording medium 1, a second roller 58*b* disposed transportation-wise upstream of the first roller 58*a* and adapted for coming into contact with the front surface of the recording medium 1, a third roller 58*c* disposed transportation-wise downstream of the first roller 58*a* and adapted for coming into contact with the front surface of the recording medium 1 and a bracket 58*e* for rotatably supporting roller shafts 58*d* of these rollers.

These three rollers are disposed basically at the same position of the transport roller mechanism 54*b* and in this case too only the first roller 58*a* is a drive roller. Further, roller shafts 58*d* of the first roller 58*a* and the second roller 58*b* are supported to the bracket 58*e* immovably and with substantially horizontal posture. Whereas, the roller shaft 58*d* of the third roller 58*c* is inserted into a vertical guide hole 58*f* defined in the bracket 58*e*, so that the third roller 58*c* presses, by its dead weight, the recording medium 1 between this third roller and the peripheral face of the first roller 58*a*. Incidentally, opposed ends of the roller shaft 58*d* of the third roller 58*c* are independently vertically movable within the corresponding guide holes 58*f*. That is to say, this third roller 58*c* can also assume an inclined posture relative to the horizontal with the range permitted by the length of the guide hole 58*f*.

Each of these rollers of the press roller mechanism 58 has a length longer than the maximum width of the recording medium 1 and the roller comprises a metal drum having laminated foamed resin on its surface. And, the dead weight of the third roller 58*c* is set so that when the roller presses the recording medium 1 therebetween with the first roller 58*a*, an ironing effect is generated for smoothing out wrinkles or the like which may have developed in the recording medium 1 during the heating fixing process. Although the value of this dead weight will be determined through experiment or experimentally depending on the plasticity of the recording medium 1 when adjacent the press roller mechanism 58 or the load (depends on the length and the outer diameter of the roller) per unit area to be applied to the medium, any adjustment in this weight will be effected by means of a weight provided as an accessory. Needless to say, it is also possible to provide, by means of a spring or the like, the third roller 58*c* with an urging force toward the peripheral face of the first roller 58*a*.

As may be apparent from FIG. 7, the axis of the third roller 58*c* is offset to the downstream side from the axis of the first roller 58*a* relative to the transporting direction. With this offset arrangement, the tangent between the third roller 58*c* and the first roller 58*a* is inclined downwardly from the horizontal by a range of 5 degrees to 60 degrees (30 degrees in the case of the example shown in FIG. 7). As a result, the recording medium 1 will be bent at this pressing area slightly downward. Namely, the press roller mechanism 58 constitutes a curved transporting section for forcibly bending the recording medium 1 discharged or being discharged from the heating space into a direction where the recording medium 1 is bent as viewed from its lateral side. Therefore, it may be said that this press roller mechanism 58 constitutes a "smoothing-out mechanism D" which provides the two effects, i.e. the ironing effect by the pressing action from the rollers and the flattening effect based on bending of the medium into a predetermined posture.

Incidentally, all of the rollers constituting the heating transporting mechanism 54 are driven directly or indirectly via an unillustrated transmission belt. In this, although the third roller 58*c* has its roller shaft 58*d* movable to and away from the recording medium 1, this third roller 58*c* may be driven by means of a transmission mechanism having a tension adjusting pulley or the like which per se is well-known.

(Curved Transporting Section 59)

The curved transporting section 59 is disposed downstream adjacent the press roller mechanism 58. The section comprises a guide body 59*a* having a guide face for guiding the recording medium 1 such that its face bearing an image may be oriented to the outside. The guide face of the guide body 59*a* has a mildly arc-like cross section having a radium of about 40 to 120 mm. Further, arrangement is made such that an extension line of the recording medium 1 clamped between the third roller 58*c* and the first roller 58*a* of the press roller mechanism 58 is in substantial agreement with a common tangent of the guide face of the guide body 59*a* and the first roller 58*a*.

When the recording medium 1 is slid along the face of such guide body 59*a* while being pressed against it (by the dead weight of the recording medium 1 slid down from the slow cooling unit CU to be described later), there is generated a tension on the front surface of the medium 1, which force serves to smooth out fine surface wrinkles therein.

Incidentally, in the recording medium 1, there tend to develop such type of wrinkles which appear as wave-like undulations in the cross section of the medium 1. Therefore, by forcibly bending the recording medium 1 in which such wrinkles are being developed in the direction traversing these wave-like undulations, the wrinkles may be effectively eliminated. For this reason, the curved transporting section 59 too constitutes a part of the "smoothing-out mechanism D". If needed, a sheet heater and a temperature sensor may be provided also in the guide body constituting the curved transporting section 59 for allowing feedback temperature control.

(Slow Cooling Unit CU)

The slow cooling subunit CU, as shown in FIG. 5 and FIG. 6, includes a slow cooling guide member 92 acting as a transportation guide body for the recording medium 1, a slow cooling intermediate transporting roller pair 94, and a turn guide 95, a discharging roller pair 96 and these components together constitute a slow cooling transporting line inclined downward for the recording medium 1. This slow cooling transporting line is disposed inside a slow cooling space which is substantially closed by a slow cooling case 91. The slow cooling guide member 92 extends with a width exceeding the maximum width of the recording medium 1 so as to form an inclined guide face for coming into face contact with the recording medium 1. The inclination of the inclined face is determined within a range between 20 degrees and 60 degrees relative to the vertical axis (about 60 degrees in the case of the exemplary construction shown in FIG. 5). To the rear face or inside of the slow cooling guide member 92, there is mounted an electric wire 93 for transmitting heat to this slow cooling guide member 92.

Figure 8:
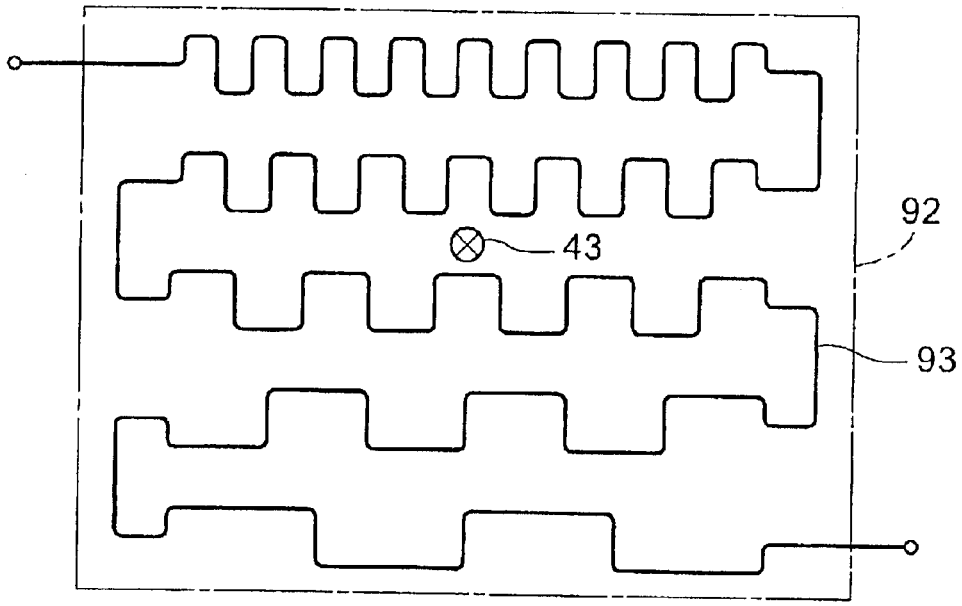
FIG. 8 is a perspective view showing a layout of an electric wire provided in a slow cooling guide member.
Figure 9:
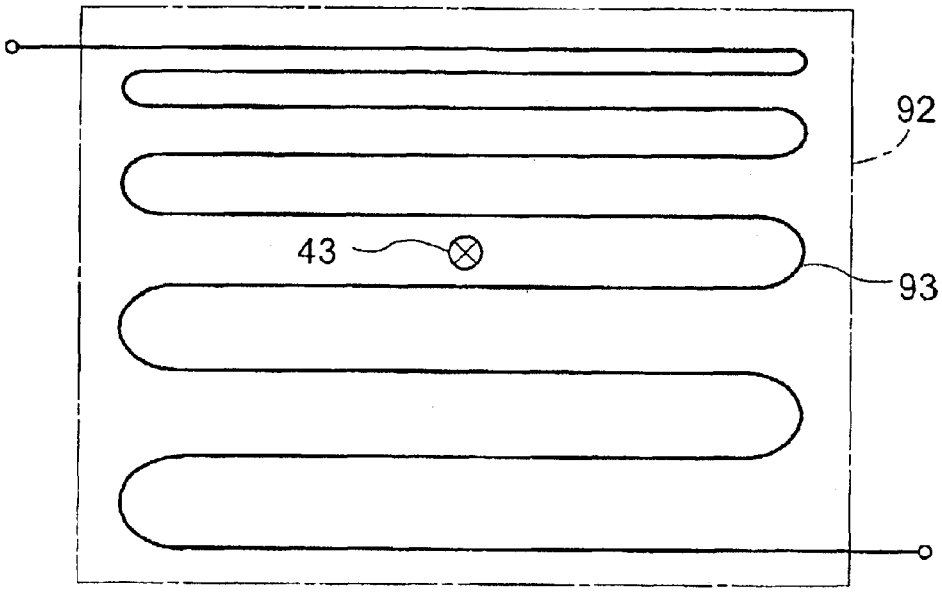
FIG. 9 is a schematic view showing a further layout of the electric wire provided in the slow cooling guide member.

The layout of the electric wire 93 and the amount of power to be supplied thereto are set such that the temperature at the recording medium entrance of the slow cooling guide member 92 may be substantially equal to the temperature at the exit of the heating fixing unit HU and also that the temperature at the recording medium exit of the slow cooling guide member 92 may be substantially equal to the room temperature and also the temperature gradient therebetween may form as mild as possible curve. With this, occurrence of deformation such as wrinkles in recording medium 1 during its cooling process may be effectively restricted. Specifically, to this end, as shown in FIG. 8, the electric wire 93 is arranged in such a manner as to provide a relatively high disposing density on the transportation-wise upstream side relative to the slow cooling guide member 92 and a relatively low disposing density on the transportation-wise downstream side. In order to obtain a temperature gradient having as mild as possible curve, as shown in FIG. 9, a meander layout having continuously variable disposing pitch may be employed also. In the embodiment modes of FIG. 8 and FIG. 9, the electric wire 93 comprises a single wire. Hence, by varying the power to be supplied to the electric wire 93, the temperature in the slow cooling guide member 92 will be raised or lowered correspondingly.

As a predetermined electric current is supplied to this electric wire 93, in the slow cooling guide member 92, there is developed such temperature gradient described above effective for restricting occurrence of wrinkles, e.g. temperature gradient from about 180° C. to 20° C. This control of the power to be supplied to the electric wire 93 is effected with accuracy by means of the controller 7, using, as feedback, the detection signal from a slow cooling temperature sensor 43 disposed directly at the intermediate area of the slow cooling guide member 92 or disposed upwardly of the guide face. Therefore, the slow cooling unit CU too constitutes a part of the "smoothing-out mechanism D".

Figure 10:
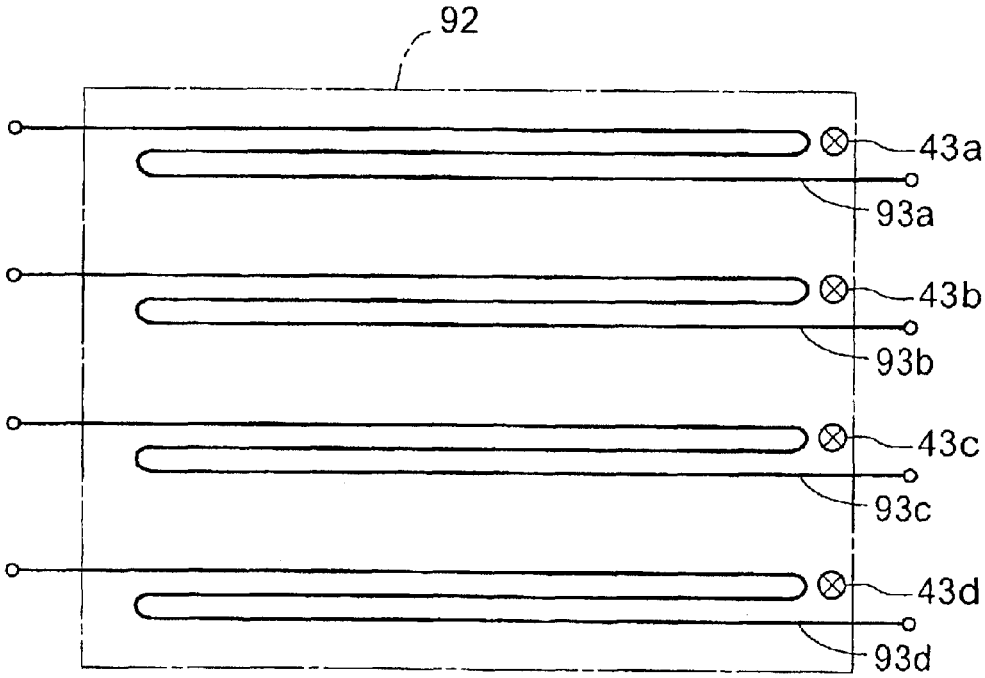
FIG. 10 is a schematic view showing a layout of the electric wire provided in the slow cooling guide member according to a further embodiment.

As an embodiment allowing desired adjustment of the temperature gradient in the slow cooling guide member 92 in the transporting direction, for instance, as shown in FIG. 10, the electric wire 93 may be divided into a first electric wire 93*a*, a second electric wire 93*b*, a third electric wire 93*c*, a fourth electric wire 93*d*, and so on, in the order from the area adjacent to the recording medium entrance to the area adjacent the recording medium exit, so as to allow independent control of the power to be supplied to the respective wires. In this case, at positions corresponding to these respective electric wires 93*a*, 93*b*, 93*c*, 93*d*, . . . , a plurality of slow cooling temperature sensors 43*a*, 43*b*, 43*c*, 43*d* . . . will be provided, so that the respective electric wires may be feedback controlled whereby a desired temperature gradient may be developed in the slow cooling guide member 92 as a whole. This alternative construction will be particularly advantageous in such case where the fixing temperature greatly varies depending on the type of the recording medium 1 employed or the room temperature significantly varies from one season to another.

Figure 2:
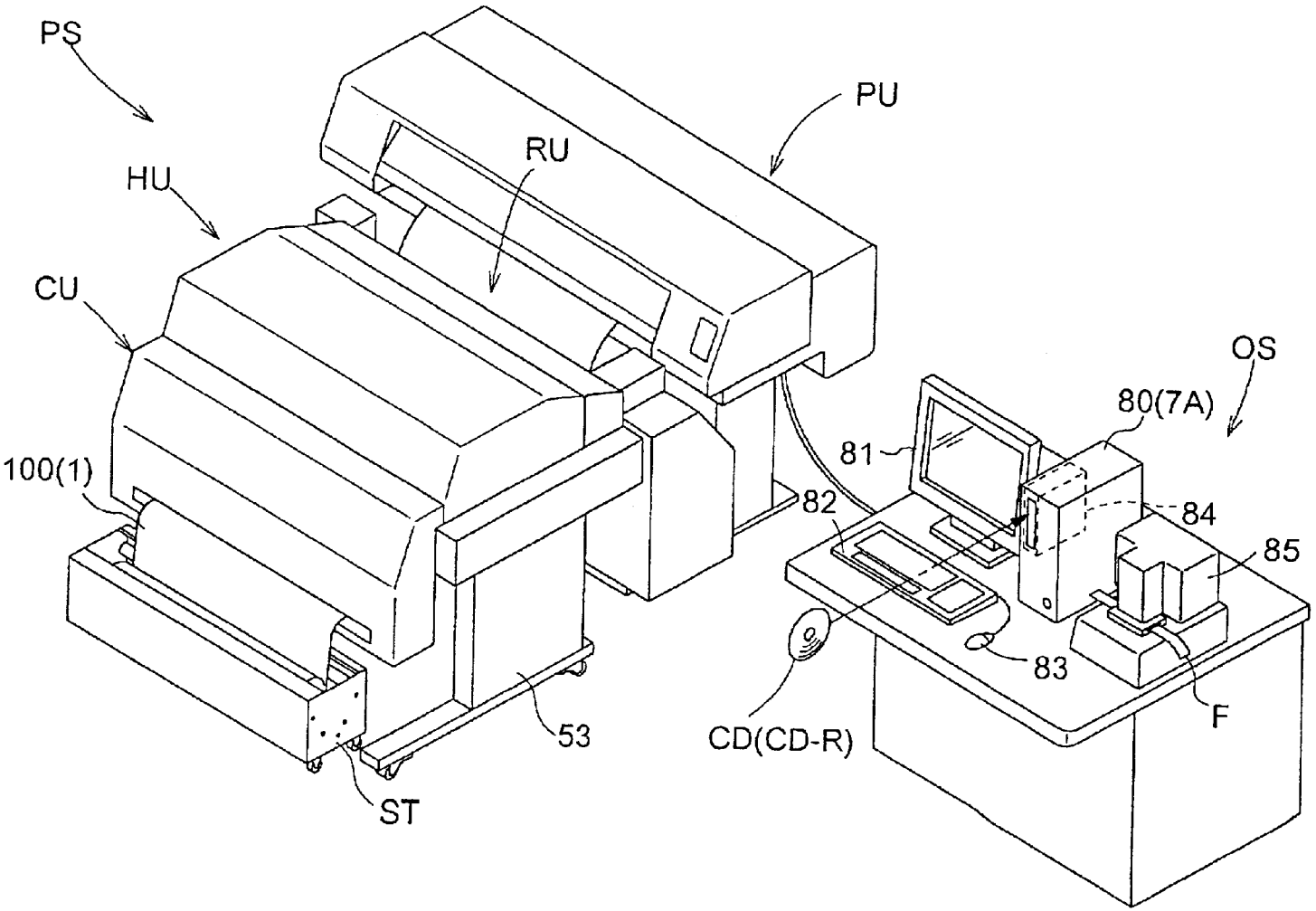
FIG. 2 is an appearance view of an image forming apparatus according to one preferred embodiment of the invention.

In order to receive the recording medium 1 discharged from the slow cooling unit CU, as shown in FIGS. 2 and 3, there is provided a stocker ST. This stocker ST comprises a box-like member having a width greater than the maximum width of the recording medium 1 which can be processed. And, its inside has a lining of sheet interwoven with carbon fibers having conductivity for eliminating static electrical charge. Further, as the recording medium 1 discharged from the slow cooling unit CU has a certain amount of curling tendency, then, by utilizing this curling tendency, the medium will be wound without a core inside the stocker ST for storage therein. In the recoding medium 1 wound and stored within the stocker ST, the ink (pigment) forming its printed image are already fixed within the fixing layer 11. Then, by removing the surface layer 12, a finished printed product 100 having a clearly color-developed image may be obtained.

(Controller 7)

As shown in FIG. 11, the controller 7 functioning as a control unit for the image forming apparatus having the above-described construction includes a first controller 7A provided in an operator's station OS and a second controller 7B provided in the printing station PS, with the two controllers 7A, 7B being connected to each other via communication cable for allowing data exchange therebetween, so that the two controllers 7A, 7B may function just like a single controller.

(Operator's Station OS)

As shown in FIG. 2, the operator's station OS includes a general-purpose computer 80 acting also as the first controller 7A, a monitor 81, a keyboard 82, a mouse 83, a film scanner 85 for effecting conversion of a photographic image of a developed photographic film F into image data, and an image reading unit 84 (in this case, this unit is incorporated within the computer 80) for reading or obtaining image data from a data storage medium (CD, CD-R, MO, or any kind of semiconductor memory device such as Compact-Flash or Smart-Media as well as any communication media comprising a data communication line). In the case of this image forming apparatus, the image data obtained by the film scanner 85 or the image reading unit 84 and then transmitted to the first controller 7A will be subjected to various necessary data processing operations and then the processed image data will be transmitted as source print data to the second controller 7B, so that a printed image will be formed on the recording medium 1 at the printing station PS and heated and fixed thereon.

As described above, the controller 7 includes the first controller 7A and the second controller 7B each having as a major component thereof a microcomputer system having CPU, ROM, RAM, I/O interface circuit etc.

As shown in FIG. 11, to the first controller 7A, via the I/O interface circuit, there are connected such peripheral devices as the image reading unit 84, the film scanner 85, etc. To the second controller 7B, via its I/O interface circuit, there are connected the peripheral devices incorporated in the printing station PS including the inkjet print head 2, the head feeding mechanism 3, the electric heaters 56, the crossflow fan 57, the recording medium transporting mechanism etc.

Further, a recording medium type detecting sensor 44 is provided for detecting an ID code provided on the roll sheet cartridge or on a shaft member supporting the recording medium 1 around it in the rolled state and this sensor transmits its type detection signal to the controller 7, so that the controller 7 may recognize the type of the charged recording material 1 based on this detection signal. The first controller 7A and the second controller 7B are capable of data transmission via respective communication modes thereof. For instance, the image data having been subjected to the image processing and adjustment processing at the first controller 7A will be converted into final print data, which will then be transmitted to the second controller 7B via the communication module 74*a*, 74*b* to be subsequently used for e.g. application of the sublimating ink to the recording medium 1.

The various functions provided by the controller 7 are realized by means of hardware and/or software. Referring here to only those functional elements having relevance to the present invention, the following sections are provided as typical examples; namely, an image data inputting section 71 for effecting pre-processing on the image data obtained by the image reading unit 84 or the film scanner 85 such as a format conversion or resolution conversion; an image processing section 72 for effecting image adjustments on the image data transmitted from the image data inputting section 71 such as a trimming or color adjustment; a print data generating section 73 for generating source print data for subsequent use by the print head 2 from the final image data by implementing a binarizing method such as an error diffusing method; a print controlling section 75 for driving the print head 2 in accordance with the transmitted print data for discharging ink droplets through the outlet; a transportation controlling section 76 for controlling the intermittent feeding of the recording medium 1 inside the printing unit PU in synchronism with the movement of the print head 2 in the main scanning direction, the loop transport of the recording medium 1 inside the loop-forming unit RU as well as the transport and heating of the recording medium within the heating fixing unit HU and transport of the medium 1 from the slow cooling unit CU (by means of the slow cooling intermediate roller pair 94 and the discharge roller pair 96); a heating controlling section 77 for controlling the power supply to the electric heaters 56 and the crossflow fan 57 of the heating fixing unit HU; a slow cooling controlling section 78 for controlling the power supply to the electric wire 93 as the heater for the slow cooling guide body 92 based on the temperature detected by the slow cooling temperature sensor 43; and a recording medium type identifying section 79 for obtaining type data of the charged recording medium 1 based on the ID code thereof read by the recording medium type detecting sensor 44. Incidentally, the slow cooling controlling section 78 can effect the control of the power supply to the electric wire 93, with taking into consideration, also if needed, such additional information concerning the recording medium type information obtained by the recording medium type identifying section 79 and the room temperature.

(Process of Image Formation)

Next, there will be described a typical process for producing a final printed product by using the image forming apparatus having the above-described construction.

<1> Printed Image Forming Stage

First, image data in the JPEG format read from the MO disc by means of the image reading unit 84 are transmitted as image source for this image forming apparatus to the image data inputting section 71. At this image data inputting section 71, the JPEG image data are mapped into 8-bit RGB color image data and then transmitted to the image processing section 72. Then, the image data are processed in accordance with the print size, trimming setting command, color adjustment command etc. inputted by the operator by operation of the keyboard 82 or the mouse 83. Upon completion of the predetermined image processing, the image data will be transmitted to the print data generating section 73. Incidentally, since the RGB color data have already been converted into the CMYK color image data at an appropriate stage after or before the other image processing, the color data transmitted to the print data generating section 73 are CMYK color image data. At this print data generating section 73, the CMYK color image data are converted into binary CMYK print data, which are then transmitted to the print controlling section 75. As described hereinbefore, the print controlling section 75 generates drive pulse signals for the print head 2 from the transmitted binary CMYK print data, whereby the drive elements of the print head 2 are controllably driven to form an image on the recording medium 1 with ink dots.

<2> Image Fixing Formation Stage

After being subjected to a necessary timing adjustment at the loop-forming unit RU, the recording medium 1 having an image formed on its surface layer 12 is caused to pass the preliminary heating space PR and the heating space R which are appropriately temperature-conditioned, during which the medium is exposed to thermal energy and with associated heating sublimation, the image formed on the surface layer 12 is transferred (fixed) to the fixing layer 11. Then, the recording medium 1 having undergone this heating fixing process will have its wrinkles developed during the heating process smoothed out by the press roller mechanism 58 disposed at the exit of the heating fixing unit HU and by the curved transporting section 59 to be introduced to the slow cooling unit CU.

<3> Slow Cooling Stage

Thereafter, the recording medium 1 introduced in the slow cooling unit CU will be transported obliquely downward along the surface of the slow cooling guide member 92 and pinched by the slow cooling intermediate transport roller pair 94. Then, the medium 1 will be returned to the substantially horizontal posture by means of the turn guide 95 and the discharge roller pair 96 disposed obliquely downwardly thereof and discharged to the outside of the printing station PS. The discharged recording medium 1 will be stored within the stocker ST. Then, when appropriate, by removing the surface layer 12 from the medium, there will be obtained a finished printed product 100 having an image with clear color development.

In the foregoing embodiment, the image forming apparatus consists of the printing station PS and the operator's station OS and the printing station PS includes the printing unit PU, the loop-forming unit RU, the heating fixing unit HU and the slow cooling unit CU. It should be noted, however, that the minimal constituents of the image forming apparatus of the invention are the heating fixing unit HU and the slow cooling unit CU. Needless to say, the image forming apparatus may include also all the other units or portions thereof.

Next, a further embodiment of the image forming apparatus of the invention will be described.

Figure 12:
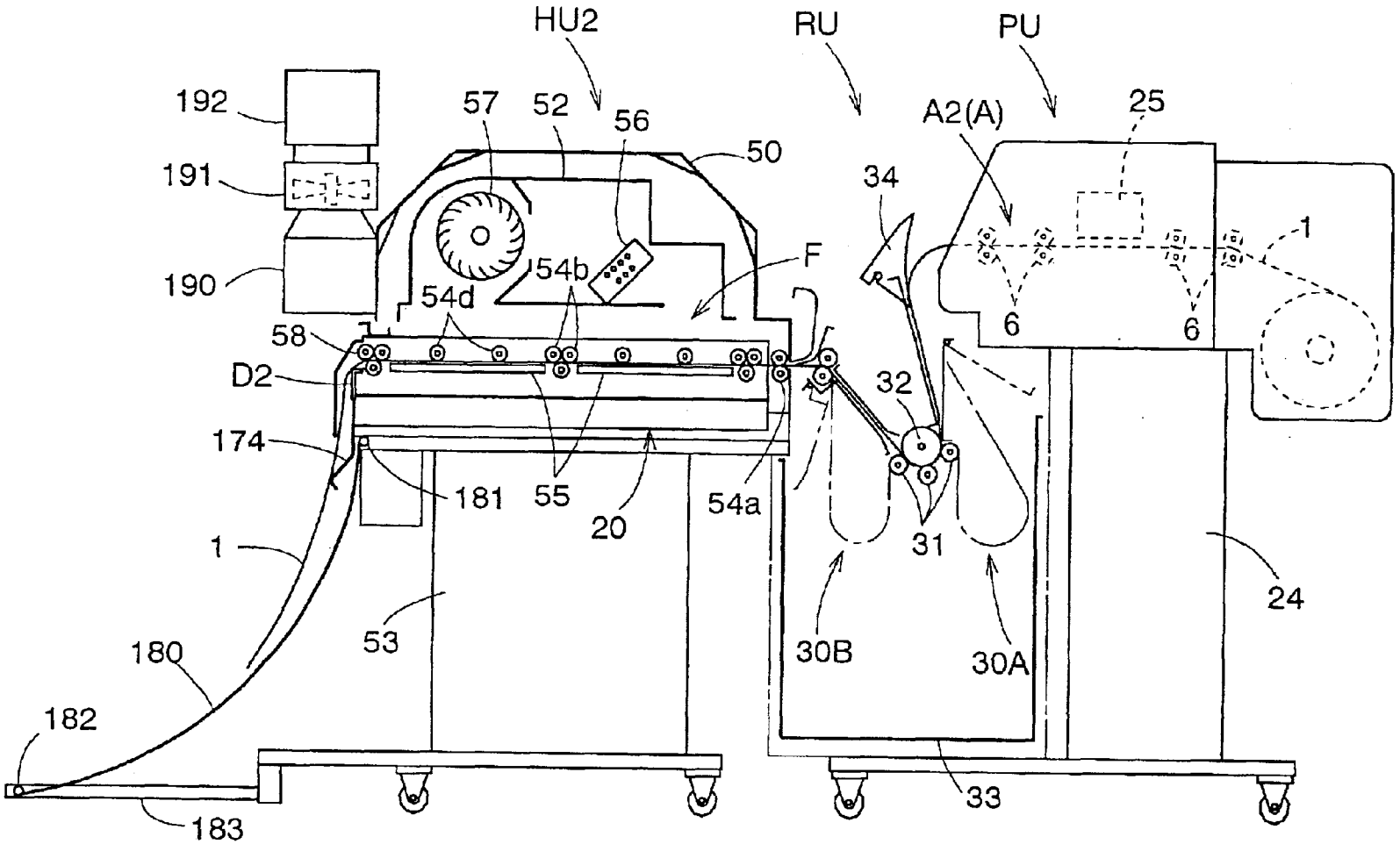
FIG. 12 is a section view showing a printing station according to a further embodiment.
Figure 13:
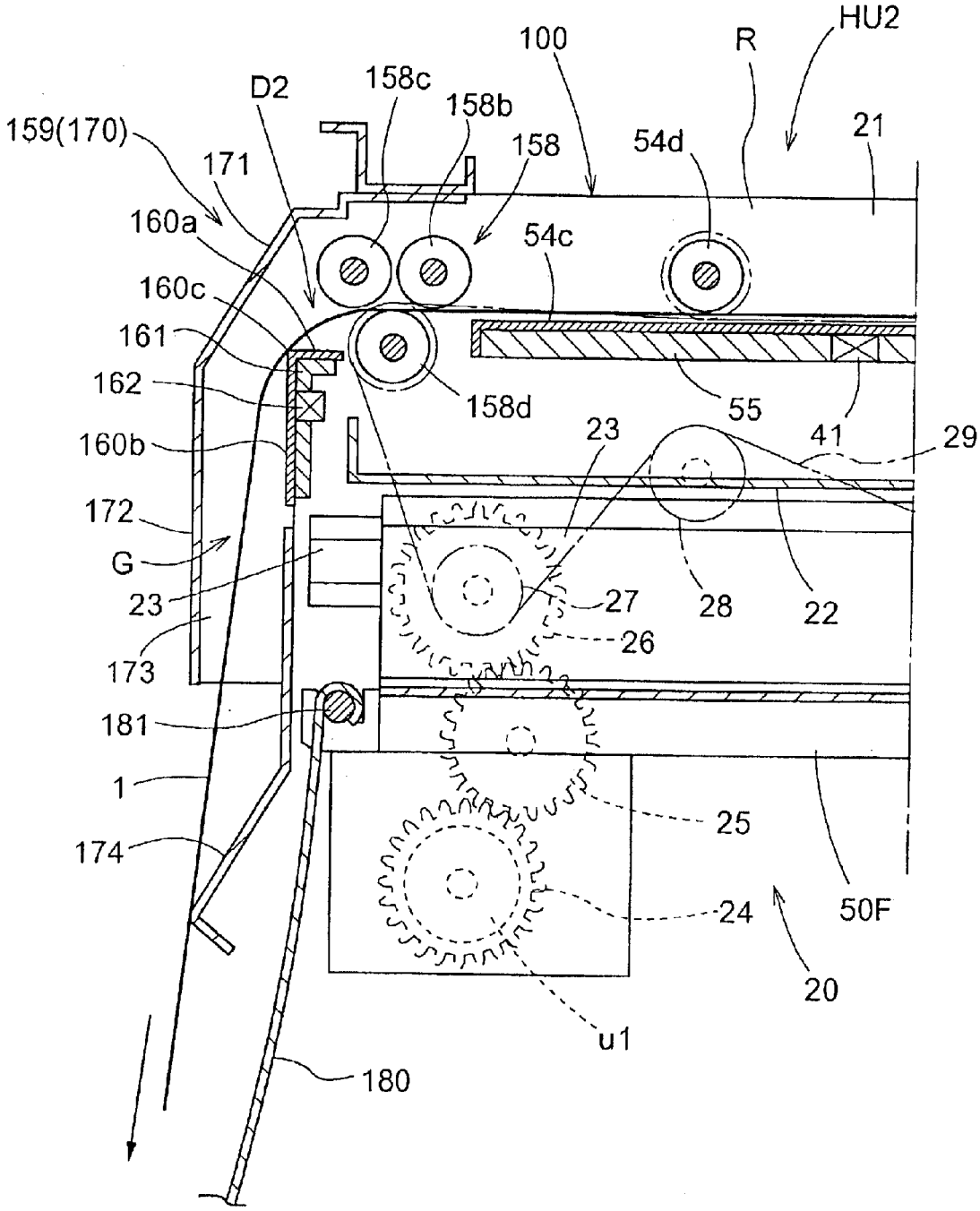
FIG. 13 is an enlarged section view showing a smoothing-out mechanism according to a still further embodiment.

An image forming apparatus shown in FIG. 12 includes a smoothing-out mechanism D2 which is slightly different from the corresponding mechanism employed in the foregoing embodiment. The smoothing-out mechanism D2 of this embodiment too includes a curved transporting section 159 for forcibly bending the cross-section shape in its lateral view of the recording medium 1 discharged from a heating fixing unit HU2 and bending it downward also.

The curved transporting section 159 of this embodiment, however, consists of an angular member 160 extending straight along the width direction of the recording medium 1 and a guide mechanism 170 for forcibly bending the recording medium 1 by pressing this medium 1 against the angular member 160. Further, the smoothing-out mechanism D2 of this embodiment does not include the press roller mechanism constituted from the vertically movable rollers; and the transport roller mechanism 158 disposed adjacent the exit of the heating fixing unit HU2 includes three rollers rotatably supported about stationary horizontal shafts, like the upstream transport roller mechanism 54*b*.

The angular member 160 includes a first flat plate member 160*a* extending parallel with the recording medium 1 discharged from the heating fixing unit HU2 and a second flat plate member 160*b* extending downward from the rear end of this first flat plate member 160*a* at an angle of 90 degrees. And, the connecting portion between the first flat plate member 160*a* and the second flat plate member 160*b* forms a projecting corner 160*c* having a right-angled cross section. The angular member 160 mounts, on its inner face, an electric heater 161 for heating the angular member 160 and a temperature sensor 162 for detecting the temperature of the angular member 160. In operation, the power to be supplied to the electric heater 161 is controlled so that the temperature detected by this temperature sensor 162 may be maintained at 180° C.

The guide mechanism 170 includes a first guide member 171 inclined downward relative to the posture of the leading end of the recording medium discharged and a second guide member 172 extending perpendicularly downward from the lower end of the first guide member 171. The discharged recording medium 1 will be guided with displacement by the first guide member 171 and the second guide member 172. As the amount of the medium discharged is increased, the medium will be discharged while being pressed against the heated corner 160*c* of the angular member 160 as being assisted by the effect of the dead weight of the recording medium 1 per se. As a result, the recording medium 1 will be bent as viewed from the lateral side thereof. Thus, the type of wrinkles appearing as wave-like undulations in the cross section of the recording medium 1 may be effectively eliminated or occurrence of such wrinkles may be avoided in advance. At the same time, as the recording medium 1 is pressed along its entire width against the heated corner 160*c* of the angular member 160, the medium 1 will be discharged while being subjected to the strong flattening effect from the corner 160*c*.

The curved transporting section 159 includes a pair of side wall members 173. These side wall members 173 cooperate with the first guide member 171 and the second guide member 172 to form a downwardly opened space S. This space S serves to realize mild heat discharge from the recording medium 1 by avoiding rapid cooling thereof.

Downwardly of this space S, there are provided a third guide member 174 which supports the recording medium 1 from the back face thereof and a stocker 180 made of cloth and disposed with an inclined posture with its leading end located downwards. The third guide member 174 and the stocker 180 guide the recording medium 1 not toward the position immediately below the space S, but in a direction away from the heating fixing unit HU2. This stocker 180 has a width greater than the maximum width of the recording medium 1 which can be processed. And, its inside has a lining of sheet made of polyester fibers having good heat resistance and interwoven with carbon fibers having conductivity for eliminating static electrical charge. The upper end of the stocker 180 is supported to a horizontal first rod 181 and its lower end is supported to a second rod 182 mounted on the floor. And, the opposed ends of this lower second rod 182 are supported to a stay 183 extending from the support leg 53 of the heating fixing unit HU2. With these, the stocker 180 is maintained with an inclined posture in which the stocker extends downwardly away from the heating fixing unit HU2.

As shown in FIG. 2, at a position upwardly of the smoothing-out section D2, there is provided a unit adapted for collecting odorous substance such as mist or gas generated at the heating fixing unit HU2. This unit includes a duct 190 which is open at the bottom thereof, an electric-powered fan 191 for sucking the mist or gas collected by this duct 190 and an eliminating mechanism 192 for eliminating the mist or the gas. This eliminating mechanism 192 may be adapted for eliminating the odor by adsorbing the mist or gas or by a chemical reaction therewith or by activity of microorganism. Specifically, the mechanism can comprise activated carbon, silica gel, zeolite, calcium silicate, ozone deodorizer, photocatalytic device, scrubbing deodorizer, etc.

The transport rollers excluding the introduction rollers 54*a*, the transmission mechanism for providing rotational drive to these transport rollers, the third guide member 174 and the smoothing-out section D2 are all supported via a slide frame 20 to the main case 50. The slide frame 20 is sidable toward the downstream side in the transporting direction of the recording medium 1. The slide frame 20 includes a pair of transmission cases 21 disposed at opposed ends of the transport rollers, a bottom wall 22 disposed at position interconnecting these transmission cases 21, and a frame interconnecting these components. And, this slide frame 20 is supported to be switchable by a sliding operation thereof between a condition where the frame is drawn out on the side of the rear face of the main case 50 and a further position where the frame is set and stored within the main case 50. In order to realize this sliding operation, between the slide frame 20 and the main case 50, there is interposed a linear guide mechanism including a pair of guide rails 23 supported in parallel with each other and steel balls (not shown) supporting the guide rails 23 such the rails 23 are sidable relative to each other.

A transport motor M1 is provided downwardly of the frame 50F of the main case 50. An intermediate gear 25 meshing with an output gear 24 of this transport motor M1 is supported to the main case and an input gear 26 meshing with this intermediate gear 25 is supported to one side face of the transmission case 21. The transmission case 21 accommodates therein an input sprocket 27 rotatable in unison with the input gear 26, an endless chain 29 for transmitting the rotational drive of the input sprocket 27 to the respective transport rollers (such as the transport roller 158*d*), and a tension roller 28 for providing a tension to the endless chain 29.

The construction of the slide frame 20 and the construction of the transporting mechanism including the transport motor Ml can be applied also to the first embodiment described hereinbefore.

The invention may be embodied in any other manner as described above. Further changes or modifications will be apparent for those skilled in the art from the foregoing disclosure within the scope of the invention defined in the appended claims.

What is claimed is:

1. An image forming apparatus for fixing, by heating, an image formed on a sheet-like recording medium thereto with subliming ink, the apparatus comprising:

a heating fixing unit for receiving and heating the recording medium and then discharging the heat-fixed recording medium, wherein the heating fixing unit comprises a heating space for heating the recording medium and a transporting mechanism for transporting the medium in the heating space;

a smoothing-out mechanism for discharging the recording medium from the heating space while smoothing out or flattening the recording medium; and a slow cooling mechanism comprising a guide member having a slide guiding face along which the recording medium is guided and a heater for controlling the temperature of the slide guide face to have a temperature gradient such that the temperature of the slide guide face is lowered gradually along the transporting direction of the recording medium;

wherein said slow cooling mechanism is disposed downstream of the smoothing-out mechanism in the transporting direction of the recording medium, and the slow cooling mechanism is adapted for slowly cooling the discharged recording medium to the normal temperature.

2. The apparatus according to claim 1, wherein the apparatus further comprises a stocker for receiving the recording medium discharged from the smoothing-out mechanism with a posture in which the leading end of the medium is inclined downward.

3. The apparatus according to claim 1, wherein the smoothing-out mechanism includes a press roller mechanism for pressing the recording medium discharged or being discharged from the heating space against a flat face.

4. The apparatus according to claim 3, wherein the press roller mechanism comprises a stationary roller supported to be rotatable about a fixed horizontal shaft and a movable roller supported to be movable closer to and away from the peripheral face of the stationary roller, the movable roller being urged in the direction closer to the peripheral face.

5. An image forming apparatus for fixing, by heating, an image formed on a sheet-like recording medium thereto with sublimating ink, the apparatus comprising;

a heating fixing unit for receiving and heating the recording medium and then discharging the heat-fixed recording medium, the beating fixing unit comprising heating space for heating the recording medium, a transporting mechanism for transporting the medium in the heating space;

a smoothing-out mechanism for discharging the recording medium from the heating space while smoothing out or flattening the recording medium;

wherein the smoothing-out mechanism comprises an angular member extending straight along the width direction of the recording medium, a guide mechanism for forcibly bending the recording medium by pressing the recording medium against the angular member, and a heating mechanism for heating the angular member.

6. The apparatus according to claim 5, wherein the angular member is disposed downwardly of the recording medium to be discharged and the guide mechanism comprises a guide face which is inclined downward relative to a posture of a leading end of the discharged recording medium.

7. The apparatus according to claim 5, wherein the apparatus further comprises a stocker for receiving the recording medium discharged from the smoothing-out mechanism with a posture in which the leading end of the medium is inclined downward.

* * * * *